US007794588B2

(12) United States Patent
Kokayeff et al.

(10) Patent No.: US 7,794,588 B2
(45) Date of Patent: Sep. 14, 2010

(54) HYDROCARBON CONVERSION PROCESS TO DECREASE POLYAROMATICS

(75) Inventors: Peter Kokayeff, Des Plaines, IL (US); Laura Elise Leonard, Des Plaines, IL (US); Michael Roy Smith, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 149 days.

(21) Appl. No.: 11/872,140

(22) Filed: Oct. 15, 2007

(65) Prior Publication Data

US 2009/0095652 A1 Apr. 16, 2009

(51) Int. Cl.
*C10G 45/44* (2006.01)
*C10G 65/02* (2006.01)

(52) U.S. Cl. ..... 208/212; 208/49; 208/89; 208/143

(58) Field of Classification Search ..... 208/49, 208/208 R, 209, 212, 213, 89, 142–143
See application file for complete search history.

(56) References Cited

U.S. PATENT DOCUMENTS

| | | | | |
|---|---|---|---|---|
| 3,130,006 | A | 4/1964 | Rabo et al. | 23/110 |
| 3,668,112 | A | 6/1972 | Parker et al. | 208/89 |
| 4,363,718 | A | 12/1982 | Klotz | 208/110 |
| 4,676,887 | A | 6/1987 | Fischer et al. | 208/61 |
| 4,738,766 | A | 4/1988 | Fischer et al. | 208/68 |
| 4,789,457 | A | 12/1988 | Fischer et al. | 208/68 |
| 4,828,677 | A | 5/1989 | Fischer et al. | 208/89 |
| 4,919,789 | A | 4/1990 | Fischer et al. | 208/61 |
| 4,943,366 | A | 7/1990 | Fischer et al. | 208/68 |

(Continued)

FOREIGN PATENT DOCUMENTS

EP 0 993 498 B1 8/2004

(Continued)

OTHER PUBLICATIONS

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

(Continued)

*Primary Examiner*—Walter D Griffin
*Assistant Examiner*—Renee Robinson
(74) *Attorney, Agent, or Firm*—James C Paschall

(57) ABSTRACT

A process is provided for producing low sulfur diesel having a reduced poly-aromatic level where at least a portion of the poly-aromatics are converted to mono-aromatics. In one aspect, the process separates the temperature and pressure requirements for obtaining low levels of sulfur from the temperature and pressure requirements to saturate poly-aromatics to mono-aromatics. By one approach, the process first converts a diesel boiling range hydrocarbon stream in a hydrotreating zone at conditions effective to produce a hydrotreating zone effluent having a reduced concentration of sulfur with minimal saturation of poly-aromatics. Hydrogen is then admixed in the hydrotreating zone effluent or at least a portion thereof, which is then reacted in a substantially liquid-phase continuous reaction zone to effect saturation of poly-aromatics to provide a liquid-phase continuous reaction zone effluent having a reduced level of poly-aromatics relative to the diesel feed.

(Continued)

20 Claims, 1 Drawing Sheet

U.S. PATENT DOCUMENTS

| | | | | |
|---|---|---|---|---|
| 4,954,241 | A * | 9/1990 | Kukes et al. | 208/59 |
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 6,123,835 | A | 9/2000 | Ackerson et al. | 208/213 |
| 6,200,462 | B1 | 3/2001 | Cash et al. | 208/89 |
| 6,294,080 | B1 | 9/2001 | Thakkar et al. | 208/100 |
| 6,428,686 | B1 | 8/2002 | Ackerson et al. | 208/213 |
| 6,444,116 | B1 | 9/2002 | Galiasso et al. | 208/58 |
| 6,497,813 | B2 | 12/2002 | Ackerson et al. | 208/311 |
| 6,638,419 | B1 | 10/2003 | Da Silva et al. | 208/208 R |
| 6,645,371 | B2 * | 11/2003 | Vuillemot et al. | 208/216 R |
| 6,881,326 | B2 | 4/2005 | Ackerson et al. | 208/213 |
| 6,890,425 | B2 | 5/2005 | Ackerson et al. | 208/311 |
| 7,094,332 | B1 | 8/2006 | Kalnes et al. | 208/97 |
| 2005/0010076 | A1 | 1/2005 | Wasserscheid et al. | 585/862 |
| 2005/0082202 | A1 | 4/2005 | Ackerson et al. | 208/213 |
| 2006/0118464 | A1 * | 6/2006 | Kalnes | 208/89 |
| 2006/0144756 | A1 | 7/2006 | Ackerson et al. | 208/108 |

FOREIGN PATENT DOCUMENTS

WO WO 00/34416 * 6/2000

OTHER PUBLICATIONS

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

U.S. Appl. No. 11/300,007, filed Dec. 14, 2005, Leonard.

U.S. Appl. No. 11/460,307, filed Jul. 27, 2006, Leonard.

U.S. Appl. No. 11/618,623, filed Dec. 29, 2006, Kokayeff.

U.S. Appl. No. 11/872,102, filed Oct. 15, 2007, Kokayeff.

U.S. Appl. No. 11/872,084, filed Oct. 15, 2007, Leonard.

U.S. Appl. No. 11/872,251, filed Oct. 15, 2007, Kokayeff.

U.S. Appl. No. 11/872,312, filed Oct. 15, 2007, Kokayeff.

U.S. Appl. No. 12/165,444, filed Jun. 30, 2008, Petri.

U.S. Appl. No. 12/165,499, filed Jun. 30, 2008, Kokayeff.

U.S. Appl. No. 12/165,522, filed Jun. 30, 2008, Kokayeff.

U.S. Appl. No. 12/495,574, filed Jun. 30, 2009, Petri.

U.S. Appl. No. 12/495,601, filed Jun. 30, 2009, Petri.

Office Action dated Jun. 4, 2009 in U.S. Appl. No. 11/460,307, Leonard.

Office Action dated Jun. 12, 2009 in U.S. Appl. No. 11/618,623, Kokayeff.

* cited by examiner

HYDROCARBON CONVERSION PROCESS TO DECREASE POLYAROMATICS

FIELD

The field generally relates to a hydrocarbon conversion process for the production of low sulfur diesel having a reduced level of poly-aromatics. In particular, the process relates to a hydrocarbon conversion process including a substantially liquid-phase continuous reaction zone.

BACKGROUND

While not intending to be limited by theory, poly-aromatics (hydrocarbons containing aromatic rings with two or more fused rings) are believed to be at least partially responsible for soot emissions from typical diesel engines. Current levels of poly-aromatics in diesel fuels, for example, can range around 3 to 4 weight percent and, in some cases, be as high as about 50 weight percent. While desirable levels of poly-aromatics in diesel fuels have yet to be determined, a reduction in poly-aromatic levels in diesel fuels to less than about 3 weight percent and as low as 1 weight percent or less is one approach for limiting soot emissions from diesel engines.

A distillate hydrotreating unit often is used to produce a diesel boiling range hydrocarbon stream having ultra low sulfur levels of about 10 wppm or less of sulfur. However, a substantial reduction in poly-aromatic content may be difficult to reach and maintain using conventional distillate hydrotreaters and their catalyst/reaction conditions. Such units typically are not configured to operate at conditions necessary to achieve and maintain low levels of poly-aromatics.

To obtain substantial reduction in poly-aromatics, a conventional distillate hydrotreating unit typically must be modified to operate at significantly higher pressures and/or temperatures. Alternatively, high-pressure three-phase hydroprocessing units, commonly known as trickle bed reactors, can be constructed to re-process the diesel from existing distillate hydrotreaters. Constructing such new reactor systems employing higher pressure capabilities would present a considerable expense to the refiner. Suitable high pressure processing units may include trickle-bed reactors operating with either a noble metal catalyst or high pressure trickle bed reactors charged with base metal catalysts. Such units often require costly recycle gas compressors to recycle large quantities of hydrogen gas, typically between about 2,000 and about 10,000 SCF/B, which is necessary in these three-phase reactor systems.

Two-phase hydroprocessing (i.e., a liquid hydrocarbon stream and solid catalyst) also has been proposed in some cases to process certain hydrocarbon streams into other more valuable hydrocarbon streams. For example, the reduction of sulfur in certain hydrocarbonaceous streams may employ a two-phase reactor with pre-saturation of hydrogen as an alternative to three-phase systems. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci., 59:2821-2829 (2004).

These two-phase systems only use enough hydrogen to saturate the liquid-phase in the reactor. As a result, the reaction systems of Schmitz et al. do not provide for decreasing hydrogen levels due to hydrogen consumption during the reaction process, thus the reaction rate in such systems decreases due to the depletion of the dissolved hydrogen.

Such two-phase systems as disclosed in Schmitz et al., therefore, are generally limited in practical application and in maximum conversion rates.

Other uses of liquid-phase reactors to process certain hydrocarbonaceous streams require the use of diluent/solvent streams to aid in the solubility of hydrogen in the oil feed. For example, liquid-phase hydrotreating of a diesel fuel has been proposed, but requires a recycle of hydrotreated diesel as a diluent blended into the oil feed prior to the reactor. In another example, liquid-phase hydrocracking of vacuum gas oil is proposed, but likewise requires the recycle of hydrocracked product into the feed to the liquid-phase hydrocracker as a diluent.

Because hydrotreating and hydrocracking typically require large amounts of hydrogen to effect their conversions, a large hydrogen demand is still required even if these reactions are completed in liquid-phase systems. As a result, to maintain such a liquid-phase hydrotreating or hydrocracking reaction in such systems and still provide the needed levels of hydrogen, such prior liquid-phase systems require the introduction of additional diluents or solvents to dilute the reactive components of the feed relative to the amount of dissolved hydrogen. As a result, in such prior systems, the diluents and solvents provide a larger concentration of dissolved hydrogen relative to the feed to insure adequate hydrogen is dissolved in the liquid to effect the conversion rates in the liquid-phase. Larger, more complex, and more extensive liquid-phase reactors are needed in these systems to achieve the desired conversions.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

SUMMARY

A process is provided to produce a low sulfur diesel and, in one aspect, an ultra low sulfur diesel with a low poly-aromatic content where a portion of the poly-aromatics is converted to mono-aromatics. In one aspect, the process is effective to reduce the poly-aromatic content in a diesel boiling hydrocarbon stream to less than about 3 weight percent and, in some cases, less than about one weight percent.

In general, the processes herein provide a cost effective method to achieve a low-sulfur, low poly-aromatic diesel by separating the temperature and pressure requirements to achieve the sulfur levels from the different temperature and pressure requirements to convert a portion of the poly-aromatics to mono-aromatics. In one aspect, a process is provided that uses a lower pressure distillate hydrotreating zone to first desulfurize a hydrocarbonaceous stream and then uses a substantially liquid-phase or generally liquid-phase continuous reaction or hydroprocessing zone at higher pressure to saturate poly-aromatics in the previously desulfurized stream to convert a portion of the poly-aromatic content to mono-aromatics. As a result, the processes herein preferably eliminate the need for a high pressure hydrotreater in order to reduce the poly-aromatic level and, as a result, avoid the need for large volumes of high pressure hydrogen and the associated costly, high-pressure recycle gas compressor.

In another aspect, the substantially liquid-phase continuous reaction zone is preferably operated at moderate pressures to saturate a portion of the poly-aromatics in a desulfurized, high cetane hydrocarbon stream to mono-aromatics to achieve the desired poly-aromatic level in the final product. In yet another aspect, a light gaseous stream is first separated from the feed to the liquid-phase reaction zone, which reduces the volume of the total flow to the liquid-phase zone so that only a much smaller portion of the total flow requires treatment in the substantially liquid-phase continuous reaction zone. This smaller flow will generally reduce operating costs for the system as a whole.

In yet another aspect, the substantially liquid-phase continuous reaction zone operates without a hydrogen recycle, other hydrocarbon recycle (such as, for example, a recycled or other hydroprocessed stream having a reduced level of poly-aromatics as compared to the hydrocarbonaceous feed stream), or admixing other hydrocarbons into the liquid-phase feed. In such aspect, the hydrotreated effluent is preferably without a substantial hydrocarbon content provided from the substantially liquid-phase continuous reaction zone. Sufficient hydrogen can be dissolved into the liquid feed of the liquid-phase reactors relative to the poly-aromatic content therein so that substantial dilution of the feed is generally not necessary to provide sufficient dissolved hydrogen to convert poly-aromatics to mono-aromatics. As a result, the liquid-phase reaction zone operates with a smaller and much simpler flow scheme to achieve the desired poly-aromatic reduction.

Ultra low levels of sulfur are typically sulfur levels of about 10 wppm or less. Feed stocks that may be processed in the desulfurization zone may have cetane numbers between about 15 and about 60, while feed stocks to the liquid-phase continuous reaction zone generally have a cetane number of at least about 30 and, preferably, between about 30 and about 60. However, feed stocks having varying cetane numbers and sulfur levels may also be used. In one aspect, low pressure is generally about 4.8 MPa (700 psig) or less; moderate pressure is generally about 4.8 MPa (700 psig) to about 6.9 MPa (1000 psig); and high pressure is generally above about 6.9 MPa (1000 psig). However, other pressure ranges also may be used depending on the feeds stocks and desired outputs.

In one aspect, a suitable feed stream is a diesel boiling range distillate or a diesel boiling range hydrocarbonaceous stream, which typically is a hydrocarbon stream with a mean boiling point of at least about 265° C. (509° F.) and generally from about 121° C. (250° F.) to about 382° C. (720° F.). In such an aspect, to achieve less than about 3 weight percent poly-aromatics (in another aspect, less than about one weight percent poly-aromatics) in the end product, the feed stream is subjected to conversions of at least about 50 percent and, in another aspect, at least about 95 percent of the poly-aromatic content in the diesel boiling range distillate feed to mono-aromatics.

In another aspect, once the desired sulfur level of the diesel boiling range stream is obtained in the hydrotreating zone under low pressure, hydrogen is admixed with the low-sulfur, hydrotreating zone effluent (or at least a portion of the hydrotreating zone effluent) at a level to generally maintain a substantially liquid-phase. This substantially liquid-phase stream then is directed to the substantially liquid-phase continuous reaction zone in order to effect a conversion of at least a portion of the poly-aromatics to mono-aromatics under substantially liquid-phase conditions.

In yet another aspect, the hydrogen is in a form available for substantially consistent consumption in the subsequent liquid-phase continuous reaction zone, and the hydrotreating zone effluent or portion thereof (i.e., feed to the liquid-phase continuous reaction zone) is substantially undiluted by other flow streams. This substantially undiluted, hydrotreating zone effluent having the admixed hydrogen therein is then reacted in the substantially liquid-phase continuous reaction zone over a catalyst to effect saturation of aromatics sufficient to provide a liquid-phase continuous reaction zone effluent having at least about 50 percent and, preferably, at least about 95 percent of the poly-aromatics from the diesel feed stream converted to mono-aromatics.

In a further aspect, the hydrotreating zone effluent or portion thereof (i.e., feed stream to the liquid-phase continuous reaction zone) has an amount of hydrogen added thereto effective to saturate the stream and, in another aspect, added above that required to saturate the liquid hydrocarbons. The additional hydrogen is in an amount effective to produce a liquid-phase that has a saturated level of hydrogen throughout the reactor as the reaction proceeds. Thus, in this aspect, the liquid-phase has a generally constant level of dissolved hydrogen from one end of the reactor zone to the other. Such liquid-phase reactors may be operated at a substantially constant reaction rate to generally provide higher conversions per pass and permit the use of smaller reactor vessels.

Such conversion and reaction rates allow the liquid-phase continuous reaction zone to operate without a liquid recycle to achieve the desired conversions of poly-aromatics to mono-aromatics. In addition, hydrogen also can be supplied to the substantially liquid-phase reactors through a slip stream from a make-up hydrogen system without the use of costly recycle gas compressors in the higher pressure zones. In this regard, the substantially liquid-phase continuous reaction zone also may operate without additional or external sources of hydrogen. For example, the entire hydrogen demand for the liquid-phase continuous reaction zone may be from the make-up hydrogen (or other hydrogen) introduced into the feed stream of the liquid-phase continuous reaction zone.

Other embodiments encompass further details of the process, such as preferred feed stocks, preferred catalysts, and preferred operating conditions to provide but a few examples. Such other embodiments and details are hereinafter disclosed in the following discussion of various aspects of the process.

DETAILED DESCRIPTION OF THE PREFERRED EMBODIMENT

Figure 1:
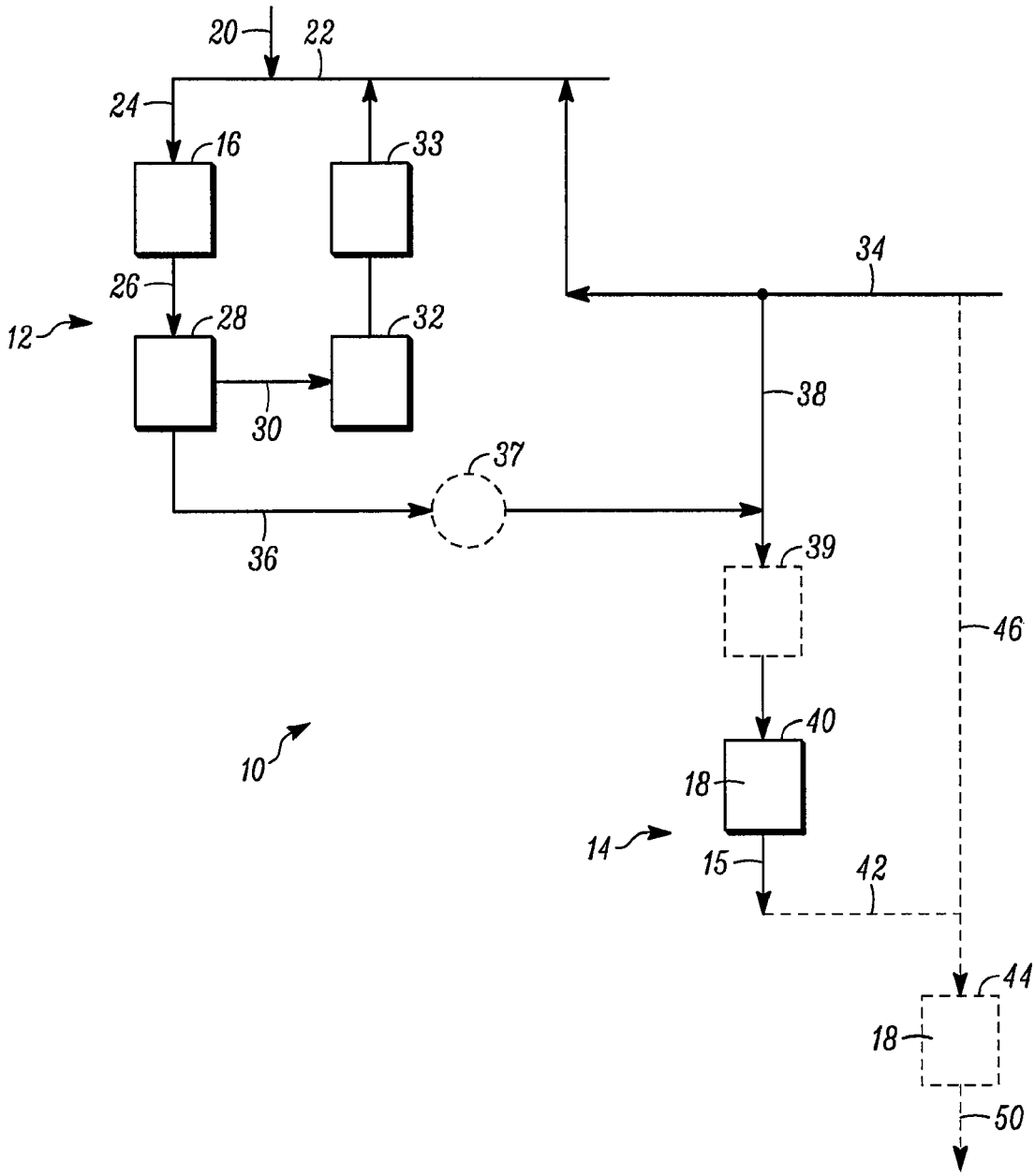
FIG. 1 is an exemplary flowchart of a process to provide low sulfur diesel having a reduced level of poly-aromatics.

In one aspect, the processes described herein are particularly useful for providing a low or ultra low sulfur diesel having a high cetane number and a low level of poly-aromatics, such as less than about 3 weight percent poly-aromatics and, in some cases, less than about one weight percent poly-aromatics. In one form, the process generally separates the temperature and pressure requirements for obtaining low sulfur diesel from the relatively higher temperature and pressure requirements to convert poly-aromatics to mono-aromatics so that only a portion of the process is subject to higher pressures needed to saturate aromatics.

In one approach, a hydrocarbon feed stream having a sulfur content and a poly aromatic content is first desulfurized at relatively low pressures to achieve the desired low sulfur levels, and then at least a portion of the poly-aromatic content in the feed stream is saturated and converted to mono-aromatics in a substantially liquid-phase continuous hydroprocessing or reaction zone. In this aspect, a costly, high-pressure recycle gas compressor typically is not necessary in the desulfurization zone in order to provide the hydrogen supply needed to desulfurize. In addition, it also is preferred that gaseous hydrocarbons are removed from the feed stream to the liquid-phase reactors; as a result, only a smaller downstream liquid portion of the entire unit is operated at higher pressures in the liquid-phase reaction zone to effect reduction in poly-aromatics.

Suitable hydrocarbon feed stocks for the process may include diesel boiling range distillates or diesel boiling range hydrocarbon streams having a mean boiling point of at least about 265° C. (509° F.) and generally from about 121° C. (250° F.) to about 382° C. (720° F.). Such feeds may have at least about 0.05 weight percent and up to about 3 to about 4 weight percent sulfur and have a cetane number of at least 15 and, in some aspects, about 30 to about 60. However, other feed streams, sulfur levels, and cetane numbers can also be used in the processes herein.

In one aspect, the selected hydrocarbon feed stock is combined with a hydrogen-rich stream and then introduced into a hydrodesulfurization unit, such as a distillate hydrotreater unit, comprising a hydrotreating zone to remove hetro atoms, such as sulfur and nitrogen. For example, the feed stock is first introduced into the hydrotreating zone having a hydrotreating catalyst (or a combination of hydrotreating catalysts) and operated at hydrotreating conditions effective, in one aspect, to provide a reduction in sulfur levels to about 10 wppm or less. In general, such conditions include a temperature from about 316° C. (600° F.) to about 427° C. (800° F.), a pressure from about 2.4 MPa (350 psig) to about 4.8 MPa (700 psig), a liquid hourly space velocity of the fresh hydrocarbonaceous feed stock from about 0.5 $hr^{-1}$ to about 5 $hr^{-1}$. Other hydrotreating conditions are also possible depending on the particular feed stocks being treated. The hydrotreating zone may contain a single or multiple reactors (preferably trickle-bed reactors) and each reactor may contain one or more reaction zones with the same or different catalysts effective to convert sulfur and nitrogen to hydrogen sulfide and ammonia. In one aspect, the hydrotreated effluent preferably has about 10 wppm or less of sulfur and a cetane number greater than about 30; however, other sulfur levels and cetane numbers also may be achieved in the hydrotreating unit depending on the feed composition and operating conditions.

At the low temperature and pressure conditions described above, the hydrotreating zone only provides a minimal reduction in poly-aromatic content or a minimal saturation of poly-aromatics. For example, in one such process, about 40 percent or less of poly-aromatics may be converted to mono-aromatics under the conditions in the hydrotreating zone. Such relatively low conversion levels generally are not sufficient to achieve the desired low levels of poly-aromatics in typical diesel feed stocks. However, the conversion level of poly-aromatics to mono-aromatics in the hydrotreating zone may vary depending on operating conditions, feed stock compositions, and other factors.

Suitable hydrotreating catalysts are any known conventional hydrotreating catalysts and include those which are comprised of at least one Group VIII metal (preferably iron, cobalt and nickel, more preferably cobalt and/or nickel) and at least one Group VI metal (preferably molybdenum and tungsten) on a high surface area support material, preferably alumina. Other suitable hydrotreating catalysts include zeolitic catalysts, as well as noble metal catalysts where the noble metal is selected from palladium and platinum. It is within the scope of the processes herein that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, and preferably from about 2 to about 25 weight percent. While the above describes some exemplary catalysts for hydrotreating, other known hydrotreating and/or hydrodesulfurization catalysts may also be used depending on the particular feed stock and the desired effluent quality.

In another aspect, the effluent from the hydrotreating zone is then introduced into a separation zone. In one such aspect, the hydrotreating zone effluent may be first contacted with an aqueous stream to dissolve any ammonium salts and then partially condensed. The stream may then be introduced into a high pressure vapor-liquid separator typically operating to produce a vaporous stream boiling in the range from about 0° C. (32° F.) to about 32° C. (90° F.) and a liquid hydrocarbon stream having a reduced concentration of sulfur and boiling in a range greater than the vaporous hydrocarbon stream. By one approach, the high pressure separator operates at a temperature from about 10° C. (50° F.) to about 177° C. (350° F.) and a pressure from about 2.1 MPa (300 psig) to about 4.8 MPa (700 psig) to separate such streams.

In yet another aspect, the vaporous stream from the separator may be directed to an amine scrubber to remove contaminates, and then back to the make-up hydrogen system and/or the hydrotreating reaction zone. Because the hydrotreating zone is operating at low pressures of 4.8 MPa (700 psig) or less, only a low-pressure recycle gas compressor is required to reintroduce the vapor from the separator back to the hydrotreating zone. As discussed above, a costly, high-pressure compressor is generally unnecessary.

The liquid hydrocarbon stream from the separator or at least a portion thereof is then admixed with hydrogen. The liquid stream with admixed hydrogen is directed to a downstream, substantially liquid-phase continuous reaction zone. In this zone, only the separated liquid fraction is subjected to the higher temperatures and pressures to saturate poly-aromatics sufficiently to convert, in one aspect, at least about 50 percent and, in another aspect, at least about 95 percent of the poly-aromatics from the diesel feed into mono-aromatics. It may be necessary to use a pump to remove the liquid from the separator and a heater to bring the temperature up to the required reaction temperature of the liquid-phase continuous reactor. The conversion levels will vary depending on diesel feed and the amounts of poly-aromatics therein, as well as the liquid-phase reactor conditions.

In another aspect, the liquid hydrocarbon stream from the separator or at least a portion thereof (i.e., the feed to the substantially liquid-phase continuous reaction zone) preferably is substantially undiluted with other streams prior to the substantially liquid-phase continuous reaction zone. That is, the substantially liquid-phase continuous reaction zone typically does not have a hydrocarbon recycle (such as, for example, a recycle of the liquid phase effluent or a recycle of a hydroprocessed stream having a reduced level of poly-aromatics as compared to the hydrocarbonaceous feed stream), other hydrocarbon streams are not admixed into the liquid hydrocarbon stream, and no hydrogen recycle is employed. Dilution of the feed to the substantially liquid-phase continuous reaction zone is generally not necessary because sufficient hydrogen can be dissolved in an undiluted stream to convert poly-aromatics to mono-aromatics. As discussed above, diluting, admixing, or blending other streams into the feed of the substantially liquid-phase reactors would generally decrease the per pass conversion rates. As a result, the substantially undiluted feed provides for a less complex and smaller reactor to achieve the desired conversion of poly-aromatics to mono-aromatics.

Generally, the substantially liquid-phase continuous reaction zone is operated at a temperature from about 343° C. (650° F.) to about 399° C. (750° F.), a pressure from about 4.8 MPa (700 psig) to about 10.3 MPa (1500 psig), and a liquid hourly space velocity from about 0.5 $hr^{-1}$ to about 5 $hr^{-1}$ to sufficiently saturate poly-aromatics to convert a portion of the poly-aromatics to mono-aromatics. The liquid-phase reaction zone preferably includes at least one Group VIII metal (preferably iron, cobalt and nickel, more preferably cobalt and/or nickel) and/or at least one Group VI metal (preferably molybdenum and tungsten) on a high surface area support material, preferably alumina. Other suitable catalysts include zeolitic catalysts, as well as noble metal catalysts where the noble metal is selected from palladium and platinum.

It is within the scope of the processes herein that more than one type of catalyst be used in the same reaction vessel. The Group VIII metal is typically present in an amount ranging from about 2 to about 20 weight percent, and in one aspect from about 4 to about 12 weight percent. The Group VI metal will typically be present in an amount ranging from about 1 to about 25 weight percent, and in another aspect from about 2 to about 25 weight percent. While the above describes some exemplary catalysts, other known catalysts may also be used depending on the particular feed stock and the desired effluent quality.

In yet another aspect, the liquid hydrocarbon stream from the separator (or portion thereof) has an amount of hydrogen added thereto to saturate the stream with hydrogen. In another aspect, hydrogen is added in excess of that required to saturate the liquid prior to being introduced into one or more liquid-phase continuous reactors in the substantially liquid-phase continuous reaction zone. That is, in such aspect, the substantially liquid-phase continuous reaction zone also preferably has a small vapor phase. In one such aspect, the additional amount of hydrogen added to the liquid stream is effective to maintain a substantially constant level of dissolved hydrogen throughout the substantially liquid-phase reaction zone as the reaction proceeds. Thus, as the reaction proceeds and consumes the dissolved hydrogen, there is sufficient additional hydrogen to continuously dissolve back into the liquid-phase in order to provide a substantially constant level of dissolved hydrogen (such as generally provided by Henry's law, for example). The liquid-phase, therefore, remains substantially saturated with hydrogen even as the reaction consumes dissolved hydrogen. Such a substantially constant level of dissolved hydrogen is advantageous because it provides a generally constant reaction rate in the liquid-phase reactors or a consistent level of hydrogen consumption.

In one such aspect, the amount of hydrogen admixed with the liquid hydrocarbon stream from the separator (i.e., feed to the liquid-phase continuous reaction zone) will generally range from an amount to saturate the stream to an amount (based on operating conditions) where the stream is generally at a transition from a liquid-phase to a gas-phase, but still has a larger liquid-phase than a gas-phase. In one such aspect, for example, the amount of hydrogen will range from about 125 percent to about 150 percent of saturation. In other aspects, it is expected that the amount of hydrogen may be up to about 500 percent of saturation and up to about 1000 percent of saturation. In one example, at the liquid-phase reaction zone conditions discussed above, it is expected that about 300 to about 400 SCF/B of hydrogen will maintain the substantially constant saturation of hydrogen throughout the liquid-phase reactor. In one aspect, such levels of hydrogen will provide greater than about 10 percent and, in other aspects, greater than about 20 percent by volume hydrogen gas in the reactors.

This level of hydrogen can be provided by a slip stream from the hydrogen make-up system and, thus, avoids the use of costly recycle or hydrogen gas compressors. In such aspect, the hydrogen will comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous system may range from the vapor phase as including small, discrete bubbles of gas finely dispersed in the continuous liquid-phase to a generally slug flow mode where the vapor phase separates into larger segments or slugs of gas traversing through the liquid. In either case, the liquid remains the continuous phase through the liquid-phase zone.

Accordingly, in this aspect, the relative amount of hydrogen required to maintain a substantially liquid-phase continuous system, and the preferred excess thereof, is dependent upon the specific composition of the hydrocarbonaceous feed stock, the level or amount of saturation of the poly-aromatics, and/or the reaction zone temperature and pressure. The appropriate amount of hydrogen required will depend on the amount necessary to provide a liquid-phase continuous system, and the preferred additional amounts thereof, once all of the above-mentioned variables have been selected.

Optionally, the liquid-phase reaction zone may include a plurality of liquid-phase continuous reactors in either a serial and/or parallel configuration. In a serial configuration, the effluent from one reactor is the feed to the next reactor, and in a parallel configuration, the feed is split between separate reactors. In each case, the feed stream to each reactor would have dissolved hydrogen therein and, preferably, be saturated, and most preferably, have additional hydrogen in excess of saturation so that each reactor has a constant amount of dissolved hydrogen throughout the reaction zone. In one aspect, the output from the liquid-phase continuous reaction zone is an effluent having the low sulfur diesel with less than about 3 weight percent poly-aromatics and, in another aspect, less than about one weight percent poly-aromatics.

DETAILED DESCRIPTION OF THE DRAWING FIGURE

Turning to FIG. 1, an exemplary hydrocarbon processing unit to provide low or ultra low sulfur diesel with low levels of poly-aromatics will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 1, an integrated processing unit 10 is provided that includes a hydrodesulfurization zone 12 to effect a reduction in sulfur levels at a first pressure and a subsequent, substantially liquid-phase continuous reaction zone 14 to effect saturation of poly-aromatics at a second pressure to convert at least a portion of the poly-aromatics to mono-aromatics. In general, the hydrodesulfurization zone 12 includes at least a hydrotreating zone 16 including one or more trickle-bed reactors operating at a low pressure. The substantially liquid-phase reaction zone 14 preferably includes one or more substantially liquid-phase continuous reactor vessels 18 operating within a substantially liquid-phase and at higher pressures than the hydrotreating zone 16. These two zones 12 and 14 function together at different temperatures and pressures to produce a product stream 15 of a low sulfur diesel having, in one aspect, less than about 10 wppm sulfur and a poly-aromatic level less than about 3 weight percent and, in another aspect, less than about one weight percent. Preferably, the diesel in stream 15 also has a cetane number of at least about 40 and, in other aspects, about 40 to about 60.

In one aspect, a hydrocarbon feed stream having a sulfur content and a poly-aromatic content, preferably comprising a distillate diesel boiling hydrocarbonaceous stream, is introduced into the integrated process 10 via line 20. A hydrogen-rich gaseous stream is provided via line 22 and joins the feed stream 20 to produce a resulting admixture that is transported via line 24 to the hydrotreating zone 16 to reduce the levels of sulfur (preferably, to about 10 wppm or less). A resulting effluent stream is removed from hydrotreating zone 16 via line 26.

The resulting effluent stream 26 from the hydrotreating zone 16 is preferably cooled and transported into a high pressure separator zone 28 where a liquid hydrocarbonaceous stream is separated from a vapor or gas stream. The gas stream is removed from the high pressure separator zone 28 via line 30 and preferably fed to an amine scrubber 32 to remove sulfur components and then to a small, low-pressure recycle gas compressor 33. Thereafter, a hydrogen rich stream may be added back to the bulk hydrogen in line 22, which is eventually added to the inlet of the hydrotreating reaction zone 16. If needed, additional hydrogen may be provided from a make-up hydrogen system via line 34.

The separated and liquid diesel boiling range distillate (which has low and, preferably, ultra low levels of sulfur) or at least a portion thereof is directed from the bottoms of the separator 28 via line 36 to the substantially liquid-phase continuous reaction zone 14. If necessary, a pump 37 may be used to transport the liquid. As discussed above, hydrogen is then admixed with the low-sulfur diesel stream 36 and is preferably provided by a slip stream 38 from the make-up hydrogen system 34. If needed, a heater 39 may also be employed to raise the temperature of the stream for reaction in the liquid-phase reactors.

In a preferred aspect, the diesel boiling range distillate in stream 36 has an amount of hydrogen admixed therewith to saturate the stream and, in other aspects, has an amount of hydrogen added in excess of saturation (e.g., hydrogen is added equivalent to about 100 percent of saturation requirements to about 1000 percent of saturation requirements). Such amounts of hydrogen are effective to permit the substantially liquid-phase continuous reaction zone 14 to operate with a substantially constant level of dissolved hydrogen (such as, for example, a hydrogen saturated liquid-phase). As the reactions consume the hydrogen, the excess hydrogen provides additional hydrogen to continuously re-dissolve back into the liquid-phase. In another aspect, the substantially liquid-phase continuous reaction zone 14 includes at least one, and in yet another aspect, two substantially liquid-phase continuous reactors 18 connected in a serial arrangement (optional reactors are shown in hashed lines in FIG. 1).

As illustrated, if more than one reactor 18 is used in a serial arrangement, a liquid-phase effluent from a first substantially liquid-phase reactor 40 is directed via line 42 to a substantially second liquid-phase reactor 44. Prior to the second reactor 44, another hydrogen slip stream 46 from the hydrogen make-up system 34 is combined with line 42 to admix hydrogen therein, which in this aspect is saturated, and, in another aspect, has additional hydrogen in excess of saturation in a manner similar to that with the first reactor. In this instance, the resulting effluent from the second reactor 44 is withdrawn as the final product via line 50 and includes the low sulfur diesel having the reduced levels of poly-aromatics.

While FIG. 1 illustrates two liquid-phase continuous reactors 18 (i.e., reactors 40 and 44) in a serial arrangement in the reaction zone 14, it will be appreciated that this configuration is only exemplary and but one possible operating flow path in this reaction zone. Depending on the particular flow rates, desired conversions, product compositions, and other factors, the liquid-phase reaction zone can include more or less reactors in either serial and/or parallel configurations.

The foregoing description of the drawing clearly illustrates the advantages encompassed by the processes described herein and the benefits to be afforded with the use thereof. In addition, FIG. 1 is intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A process for producing low sulfur diesel with reduced levels of poly-aromatics, the process comprising:

providing a diesel boiling range hydrocarbon stream with a sulfur content and a poly-aromatic content;

converting the diesel boiling range hydrocarbon stream in a hydrotreating reaction zone at hydrotreating conditions effective to produce a hydrotreated effluent having a reduced concentration of sulfur relative to the diesel boiling range hydrocarbon stream;

taking at least a portion of the hydrotreated effluent as a hydroprocessing feed;

admixing hydrogen with the hydroprocessing feed, the hydrogen in a form available for substantially consistent consumption in the substantially liquid-phase continuous hydroprocessing zone;

reacting the hydroprocessing feed substantially undiluted with another hydrocarbon stream in the substantially liquid-phase continuous hydroprocessing zone over a catalyst and at conditions effective to convert at least a portion of the poly-aromatic content in the hydroprocessing feed into mono-aromatics to form a liquid-phase continuous hydroprocessing zone effluent; and the liquid-phase continuous hydroprocessing zone effluent includes a reduced concentration of sulfur and a reduced level of poly-aromatics relative to the diesel boiling range hydrocarbon stream.

2. The process of claim 1, wherein at least about 50 percent of the poly-aromatic content in the diesel boiling range hydrocarbon stream is converted to mono-aromatics.

3. The process of claim 1, wherein at least about 95 percent of the poly-aromatic content in the diesel boiling range hydrocarbon stream is converted to mono-aromatics.

4. The process of claim 1, wherein the liquid-phase continuous hydroprocessing zone effluent comprises less than about 3 weight percent poly-aromatics.

5. The process of claim 4, wherein the hydrotreated effluent has about 10 wppm or less of sulfur and a cetane number greater than about 30.

6. The process of claim 1, wherein a pressure in the substantially liquid-phase continuous hydroprocessing zone is higher than a pressure in the hydrotreating reaction zone.

7. The process of claim 1, wherein the hydrogen is provided from a make-up hydrogen stream.

8. The process of claim 1, wherein the hydroprocessing feed is admixed with an amount of hydrogen in excess of that required for saturation of the hydroprocessing feed.

9. The process of claim 8, wherein the amount of hydrogen added to the hydroprocessing feed is up to about 1000 percent over that required for saturation of the hydroprocessing feed.

10. A process for producing low sulfur diesel with reduced levels of poly-aromatics, the process comprising:

providing a diesel boiling range hydrocarbon stream with a sulfur content and a poly-aromatic content;

converting the diesel boiling range hydrocarbon stream in a hydrotreating reaction zone at hydrotreating conditions effective to produce a hydrotreated effluent having a reduced concentration of sulfur relative to the diesel boiling range hydrocarbon stream;

admixing hydrogen with the hydrotreated effluent, the hydrogen in a form available for substantially consistent consumption in a substantially liquid-phase continuous reaction zone, and the hydrotreated effluent being substantially undiluted with another hydrocarbon stream;

reacting the substantially undiluted hydrotreated effluent in a substantially liquid-phase continuous reaction zone over a catalyst at conditions effective to convert at least a portion of the poly-aromatic content in the hydrotreated effluent into mono-aromatics to form a liquid-phase continuous reaction zone effluent; and the liquid-phase continuous reaction zone effluent includes a reduced concentration of sulfur and a reduced level of poly-aromatics relative to the diesel boiling range hydrocarbon stream.

11. The process of claim 10, wherein at least about 50 percent of the poly-aromatic content in the diesel boiling range hydrocarbon stream is converted to mono-aromatics.

12. The process of claim 11, wherein the hydrotreated effluent has about 10 wppm or less of sulfur and a cetane number greater than about 30.

13. The process of claim 10, wherein the hydrotreated effluent is admixed with an amount of hydrogen in excess of that required for saturation of the hydrotreated effluent.

14. A process for producing low sulfur hydrocarbons having a reduced level of poly-aromatics, the process comprising:

providing a hydrocarbon feed with a boiling range from about 121° C. (250° F.) to about 382° C. (720° F.), a sulfur content, and a poly-aromatic content;

reacting the hydrocarbon feed in a hydrotreating reaction zone at a pressure of about 4.8 MPa (700 psig) or less to produce a hydrotreating reaction zone effluent comprising about 10 wppm or less of sulfur and having about 40 percent or less of the poly-aromatic content in the hydrocarbon feed converted to mono-aromatics;

saturating the hydrotreating reaction zone effluent with hydrogen;

directing the hydrotreating reaction zone effluent to a substantially liquid-phase continuous reaction zone, the hydrotreating zone effluent substantially undiluted with another hydrocarbon stream;

reacting the substantially undiluted, hydrotreating reaction zone effluent in the substantially liquid-phase continuous reaction zone over a catalyst and at a pressure from about 4.8 MPa (700 psig) to about 10.3 MPa (1500 psig) effective to saturate a portion of the poly-aromatics therein to mono-aromatics to form a liquid-phase continuous reaction zone effluent with at least about 50 percent of the poly-aromatic content from the hydrocarbon feed converted to mono-aromatics; and wherein the liquid-phase continuous reaction zone effluent has a poly-aromatic content less than about 3 weight percent.

15. The process of claim 14, wherein the substantially liquid-phase continuous reaction zone includes at least two serial substantially liquid-phase continuous reactors; an effluent from the first substantially liquid-phase continuous reactor is fed to a second substantially liquid-phase continuous reactor; and each of the two serial substantially liquid-phase continuous reactors operating with hydrogen in excess of that required to effect saturation of the liquid.

16. The process of claim 14, wherein the hydrogen is provided from a make-up hydrogen stream.

17. The process of claim 14, wherein the liquid-phase continuous reaction zone effluent comprises less than about one weight percent poly-aromatics.

18. The process of claim 14, wherein the hydrotreating reaction zone effluent is admixed with an amount of hydrogen in excess of that required for saturation of the hydrotreating reaction zone effluent.

19. The process of claim 18, wherein the amount of hydrogen added to the hydrotreating reaction zone effluent is up to about 1000 percent of that required for saturation of the hydrotreating reaction zone effluent.

20. The process of claim 14, wherein the reaction proceeds in the substantially liquid-phase continuous reaction zone without additional sources of hydrogen external to the substantially liquid-phase continuous reaction zone.

* * * * *